United States Patent [19]

Beninger

[11] 3,958,392

[45] May 25, 1976

[54] METHOD AND APPARATUS FOR HEAT SHRINKING FILM ABOUT ARTICLES

[75] Inventor: Robert L. Beninger, Sheboygan, Wis.

[73] Assignee: H. G. Weber and Company, Inc., Kiel, Wis.

[22] Filed: Apr. 23, 1975

[21] Appl. No.: 570,636

Related U.S. Application Data

[63] Continuation-in-part of Ser. No. 421,989, Dec. 5, 1973, Pat. No. 3,910,011.

[52] U.S. Cl. ..... 53/24; 53/30 S; 53/184 S; 53/124 C; 53/124 D; 53/124 CC; 100/223

[51] Int. Cl.[2] ..... B65B 1/24; B65B 53/02; B65B 63/02

[58] Field of Search ..... 53/24, 30, 184, 124 C, 53/124 D, 124 CC; 100/223

[56] References Cited

UNITED STATES PATENTS

| | | | |
|---|---|---|---|
| 3,125,842 | 3/1964 | Ferguson | 100/223 X |
| 3,581,460 | 6/1971 | Lambsdorff | 53/184 X |

*Primary Examiner*—Travis S. McGehee
*Attorney, Agent, or Firm*—Hill, Gross, Simpson, Van Santen, Steadman, Chiara & Simpson

[57] ABSTRACT

Method and apparatus for packaging articles in a heat-shrinkable film. The packaging assembly includes a rotary drive means and a plurality of radial arms engagable with the drive means. An article handling apparatus consisting of a lower platen and an upper, pressure-applying platen is carried by each arm. At a loading station, a stack of the articles to be packed is compressed to a predetermined amount and a heat-shrinkable bag is applied about the package. The compressed package with the heat-shrinkable bag is then engaged with the drive means and then is directed through a heating tunnel and cooling station where it is heated and cooled for a sufficient time and at a sufficient temperature to cause the bag to shrink around the still compressed stack holding it to a positive fixed repeatable height dimension while leaving an opening in the bag at the top. The thus enclosed stack is then sent to a discharged station where it is delivered to a conveyor means or other suitable stack-handling means.

7 Claims, 7 Drawing Figures

METHOD AND APPARATUS FOR HEAT SHRINKING FILM ABOUT ARTICLES

REFERENCE TO RELATED APPLICATION

This application is a continuation-in-part of my copending application, Ser. No. 421,989 entitled "Apparatus for and Method of Packaging Stacked Articles" filed Dec. 5, 1973, now U.S. Pat. No. 3,910,011.

BACKGROUND OF THE INVENTION

1. Field of the Invention

The present invention is in the field of packaging assemblies wherein articles to be packed are enclosed in a heat-shrinkable film while under compression, and the thus enclosed stack of articles is heated to cause shrinkage of the film about the stack, then cooled while being compressed to a positive repeatable fixed height dimension.

2. Description of the Prior Art

There are numerous examples in the prior art of heatshrinking a film about articles in order to provide a tightly fitting package. For example, in Weeks U.S. Pat. No. 2,402,476 there is disclosed a method in which bags are inserted into an outside covering bag, and then pressed together preparatory to closing the bag into position to act as a bale to contain the bags and hold the compression.

Zelnick U.S. Pat. No. 3,662,512 describes a method wherein a sleeve of heat-shrinkable film is applied around a pallet load with its open end extending above the pallet load and its open bottom extending below the pallet. The top and bottom portions of the sleeve are initially shrunk to lock the sleeve onto the pallet load and the pallet, and subsequently the intermediate portion of the sleeve is shrunk.

Muskat et al. U.S. Pat. No. 3,031,809 describes another method and apparatus for packaging with a heat-shrinkable material, involving the use of a specifically designed blank composed of relatively stiff paper.

Kammer U.S. Pat. No. 3,555,772 describes a continuous method for packaging newspaper stacks involving the use of individual weights on each stack during the heat shrinking procedure.

James U.S. Pat. No. 3,362,128 describes a method of packaging articles in which a heat-shrinkable film is wrapped around an aligned stack of packaged articles, the wrapped stack is compressed and the stack is heated to shrink the film into conformity with the stack.

SUMMARY OF THE INVENTION

The present invention provides a method and apparatus for packaging products which can be of a variety of types, sizes and configurations. Paper or plastic bags can be compressed and wrapped in the shrinkable film to produce a very tightly compressed bundle with repeatable fixed height dimensions which allows for stable palletizing, less warehouse space requirements, and savings in shipping costs. Food products such as coffee in bags or food packaged in chipboard cartons can be shrink wrapped using controlled pressure while shrinking and cooling.

Basically, the packaging assembly of the present invention includes a variable speed, rotary drive means and a plurality of radial arms engagable with the drive means. Each arm carries a lower platen and an upper plate for supporting a heat-shrinkable bag and its contents. An empty carrier is moved from a discharge station to a loading station where the contents are placed on an insideout bag and compressed to a desired degree of compression. The bag is then folded over the sides of the compressed stack and about a portion of the top of the stack, where pressure means are used to fold the top portion in place. The thus compressed and wrapped stack is then sent through a heating tunnel for a predetermined period of time where the film is shrunk about the compressed contents. Finally, the compressed shrink wrapped stack after proper cooling under pressure to hold dimensional stability is sent to the discharge station where it is unloaded from between the two platens.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
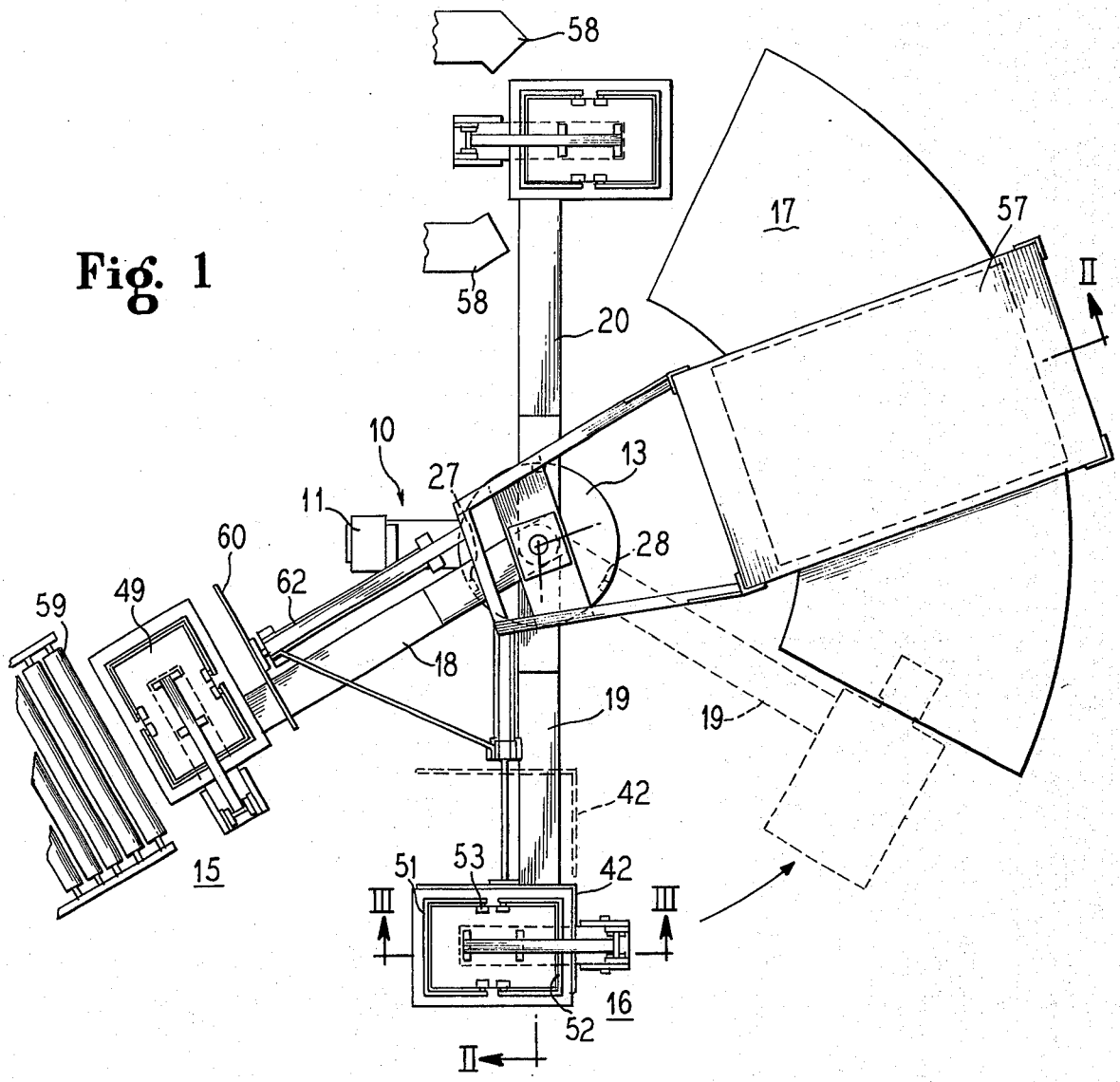
FIG. 1 is a plan view of an apparatus which can be used for the purposes of the present invention.

In FIG. 1, reference numeral 10 indicates generally a drive means consisting of a variable speed motor 11 which drives a drive shaft 12 to which there is fixedly secured a drive disk 13. Secured to the upper surface of the drive disk 13 there may be a ring 14 composed of relatively low friction material such as brass.

Figure 2:
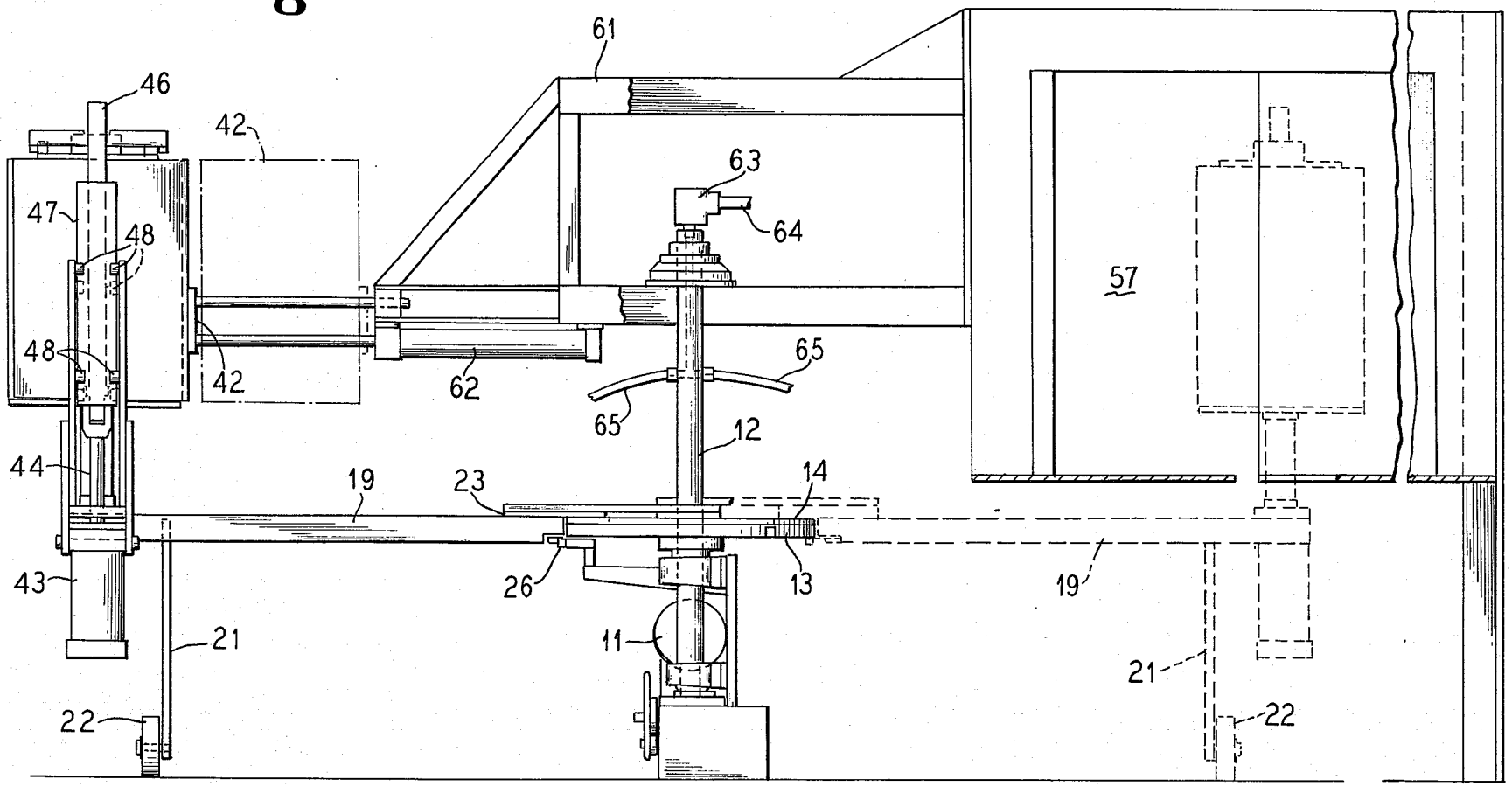
FIG. 2 is a view partly in elevation and partly in cross-section taken substantially along the line II—II of FIG. 1.

The apparatus shown in FIG. 1 is arranged to operate on a stack of articles in three stations identified generally at reference numerals 15 which is a discharge station, 16 which represents a loading station, and 17 which represents a heat shrinking station. To propel the articles through the various stations, a plurality of radially extending arms 18, 19 and 20 is provided. The radial arms are secured near their outer extremities to legs, a leg 21 being shown in FIG. 2 as extending from the radial arm 18 and having a wheel 22 thereon which permits rotation of the arms relative to the drive shaft when the arms are disengaged from the drive means as will be apparent from succeeding portions of this description. To facilitate such relative movement, each of the arms 18 through 20 is provided with a plate 23 at its inner end which rides against the surface of the ring 14.

Figure 5:
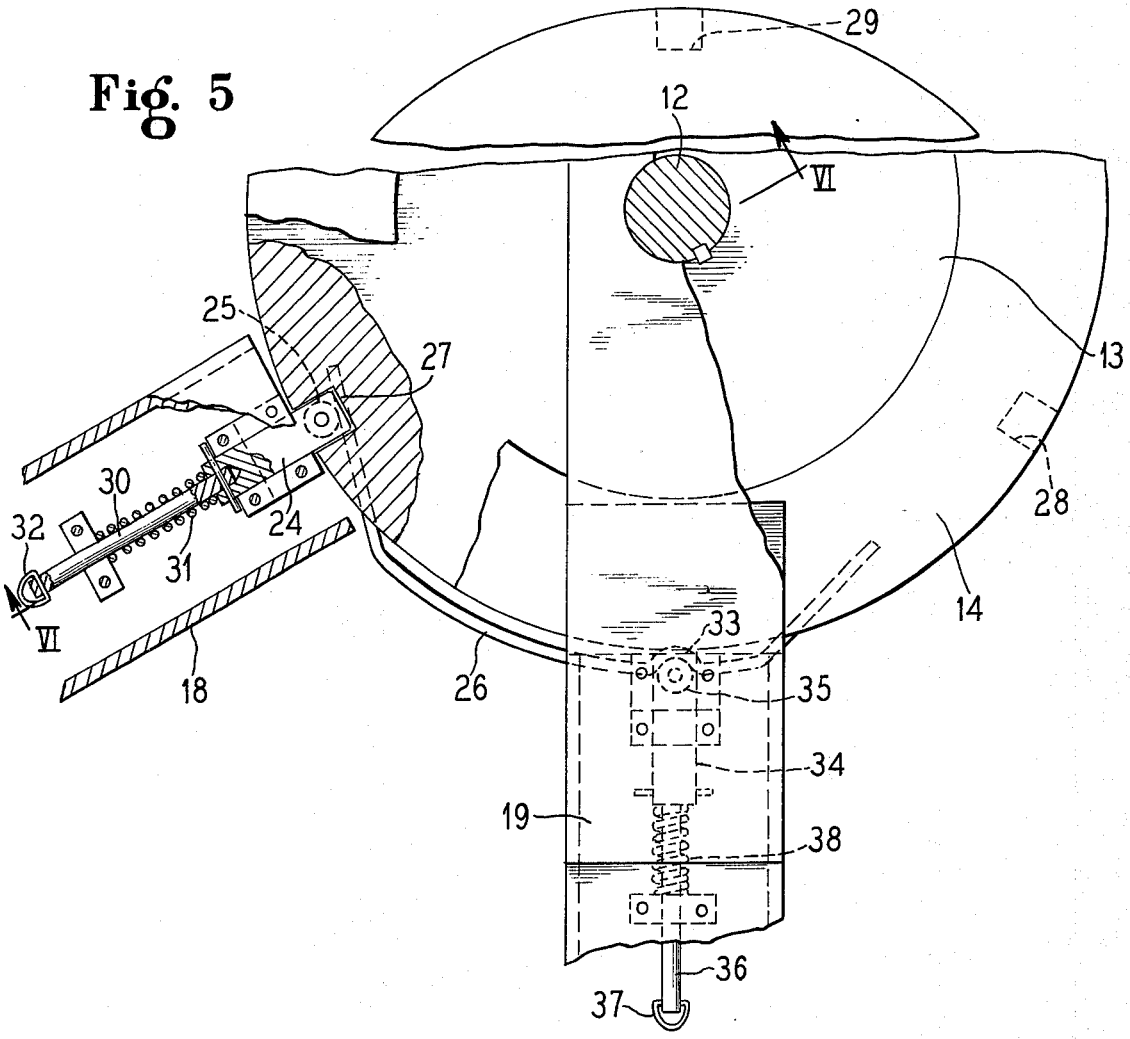
FIG. 5 is a fragmentary plan view, partly broken away, illustrating the manner of engaging the transporting devices with the drive disk.
Figure 6:
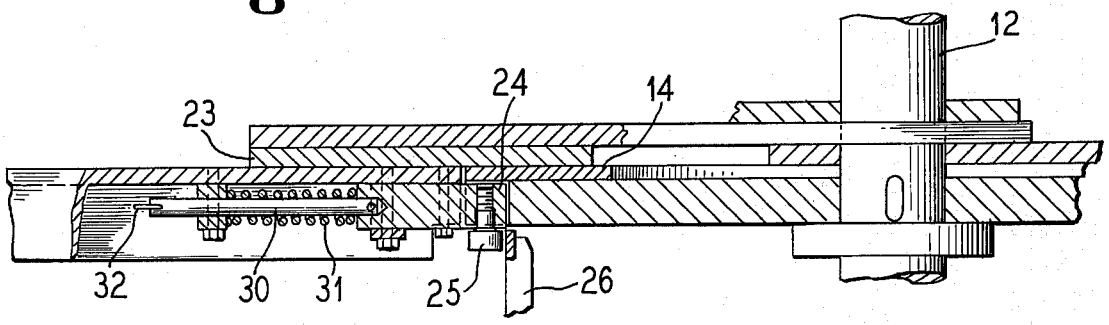
FIG. 6 is a fragmentary cross-sectional view taken substantially along the line VI—VI of FIG. 5.

The arms 18 through 20 are provided with means for engaging the drive disk 13 in driving relation or being released therefrom. Referring to FIG. 5, it will be seen that the arm 18, for example, carries a drive block 24 to which there is secured a roller 25. The roller 25 is arranged to engage a cam track 26. Driving connection between the arm 18 and the disk 13 is provided by means of a plurality of slots 27, 28 and 29 about the periphery of the disk 13 as best illustrated in FIG. 5.

In FIG. 5, the arm 18 is shown as positioned in the discharge station 15. When it is desired to move the arm 18 out of driving engagement with the disk 13, the operator pulls on a rod 30 which is secured to the drive block 24. This withdraws the drive block from the slot 27 against the action of a spring 31. A finger grip 32 may be provided to facilitate such retraction. When the drive block 25 clears the slot 27, the roller 25 rides against the cam plate 26 until it engages a detent 33, as shown in FIG. 5. This places the arm 18 in the position occupied by the arm 19 in FIG. 5, namely, at the loading station. The arm 19 is provided with the same type of retraction mechanism as the arm 18, namely, it includes a drive block 34 to which a roller 35 is secured, the drive block 34 being connected to a rod 36 having a finger grip 37 thereon for withdrawing the drive block against the action of a coil spring 38.

Figures 3, 4:
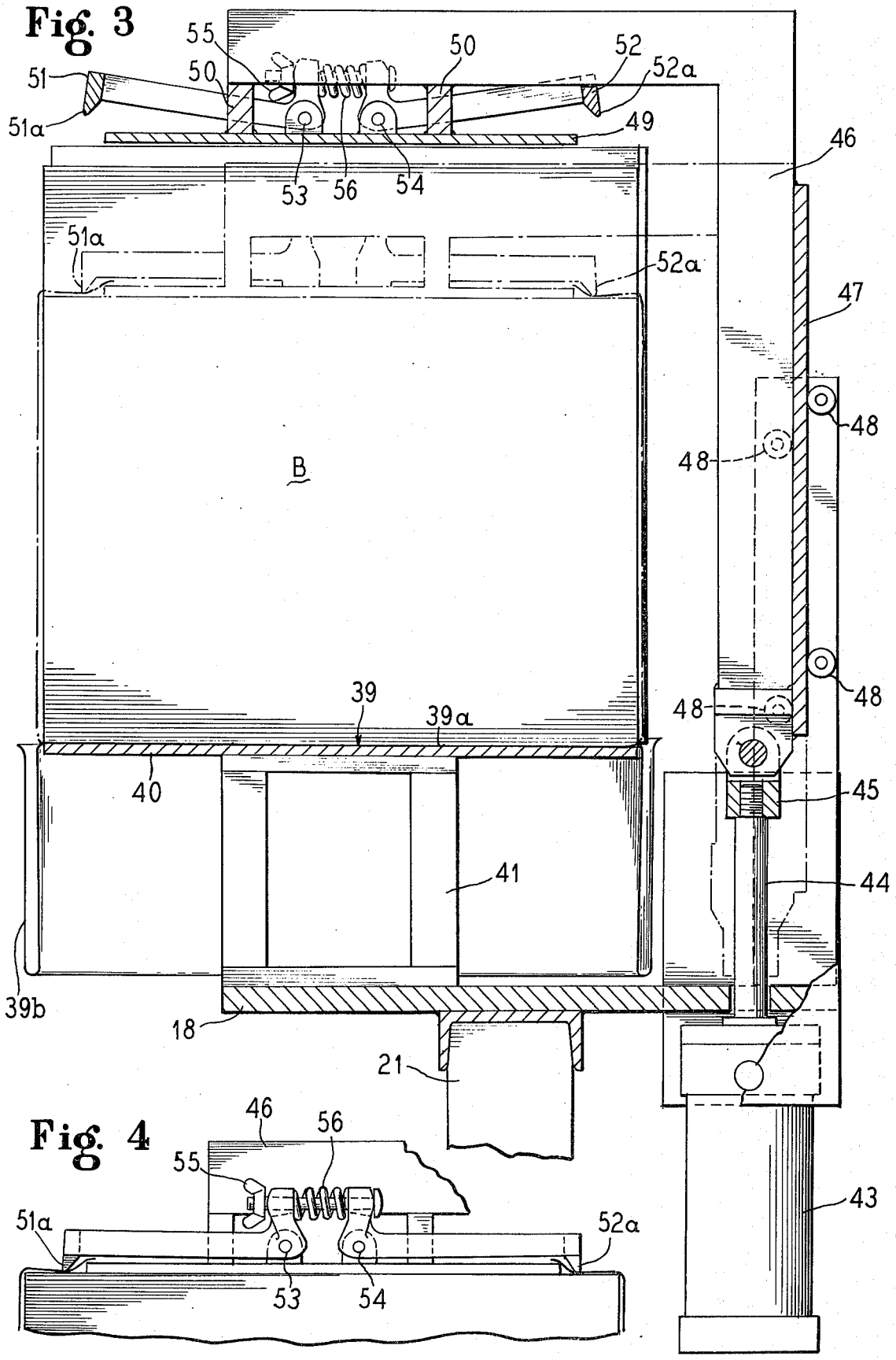
FIG. 3 is a cross-sectional view on an enlarged scale taken substantially along the line III—III of FIG. 1.
FIG. 4 is a fragmentary view in elevation of the clamping means shown in FIG. 3 in the clamping position.

At the commencement of the operation, the operator manually disengages the drive block 24 on the arm 18 from engagement with the slot 27 and moves it to the position shown in FIG. 5 for the arm 19 where it is held by the engagement between the roller 25 and the detent 33. At the loading station, as illustrated in FIG. 3, the operator places the pre-made shrink bag 39 on a bottom platen 40 which is secured to the arm 18 by means of a spacer 41. The operator places the shrink bag 39 inside out on the bottom platen 40 so that the bottom of the bag 39a rests on the platen 40, and the sides of the bag **39*b* are dropped below the surface of the bottom platen 40. A stack of articles to be packaged is then arranged on the bag bottom 39*a* with retractable right angle side guides 42 (FIG. 1**) being used to square up the stack while loading.

The next step consists in compressing the stack of articles to a predetermined vertical dimension. To accomplish this there is provided a pneumatically operated cylinder 43 which always makes a full and repeatable stroke and which operates a rod 44 which in turn is threaded into a socket 45 provided on an inverted L-shaped pressure member 46. Pressure plate 46 is adjustable in its vertical location so that with controlled air pressure and properly selected vertical location of the plate 46, the stacks of articles will be of a predetermined and repeatable height dimension. To the pressure member 46 there is secured a plate 47 which is received within opposed rollers 48 to assure that the movement of the L-shaped pressure applying member 46 is truly vertical.

An upper platen 49 is secured to the pressure member 46 by means of spacers 50. The upper platen member 49 has an area less than the area of the mouth of the bag 39 so that it readily fits within the bag and engages the stacked articles. The desired degree of compression is then applied to the stacked articles by operation of the cylinder 43. After completion of the compaction, the side guides 42 are retracted into the position shown in the dotted lines in FIG. 1.

In the next step, the sides **39*b* of the shrink bag are pulled up along the sides of the stacked and compressed articles so that they partially overlap the top of the stack as shown in FIG. 3. The marginal edge of the open-ended bag is held against the top of the stack of articles by means of a pair of U-shaped pressure arms 51 and 52. The arm 51 is mounted for pivotal movement between a pair of pivots 53 while the arm 52 is mounted for pivotal movement between a pair of pivots 54. At the ends of the arms 51 and 52, respectively, there are provided finger portions 51*a* and 52*a*, respectively, The pressure provided by the fingers 51*a* and 52*a* is regulated by means of a wing nut 55 which controls the tension on a spring 56 which urges the fingers 51*a* and 52*a*** into contact with the marginal edges of the bag.

At this stage, the stack has been fully compressed and is ready for the heat shrinking operation. The operator then disengages the roller 35 from the detent 33 and moves it to a position where the drive block 34 is received within the slot 28 of the drive disk in driving engagement. The drive system then carries the bag and its contents through the heating station 17 which includes a heating tunnel 57. The amount of shrinkage of the bag is dependent upon the residence time in the tunnel 57 which in turn depends upon the speed of the drive motor.

As the arm 19, carrying the compressed and bagged articles, enters the heating tunnel 57, the arm 20 with its heat shrunk, compressed package has just left the heating tunnel 57. Optionally, the heated bag structure can then be cooled by forced air cooling such as by means of blowers 58. When the arm 19 has been swung through the heating tunnel 57, the arm 20 will have moved to the discharge station 15. At this station, the pressure arms 51 and 52 are released, thereby lifting the fingers **51*a* and 52*a* from the compressed stack, and the cylinder 43 is operated to release the upper pressure plate 49. A pusher plate 60 then pushes the filled bag B onto the conveyor system 59. The pusher plate 60 is supported on a frame 61 which carries an air cylinder 62 to reciprocate the pusher plate 60. Also mounted on the frame 61 is a rotating fitting 63 which is fed by a conduit 64 to deliver compressed air through a plurality of lines 65 to the cylinders such as cylinder 43 to energize the same. Once the filled bag B is discharged at the discharge station 15, the operator disengages the drive block 24 from the slot 27 and manually moves it to the loading station 16** to repeat the sequence of operation.

Figure 7:
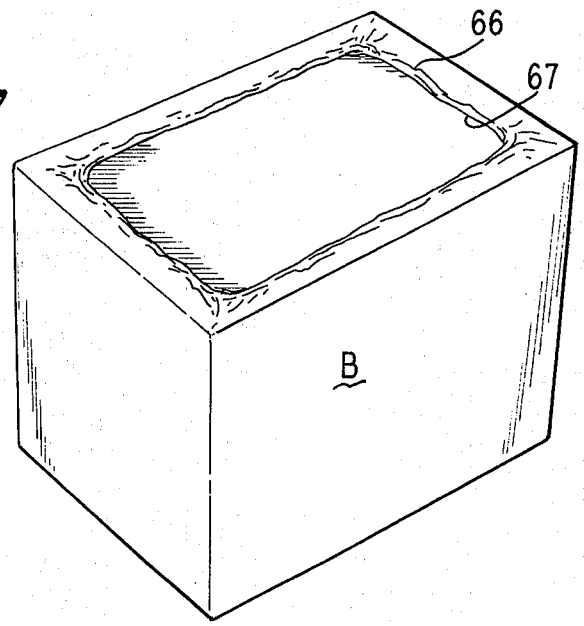
FIG. 7 is a view in perspective of the completed package produced according to the present invention.

The filled bag B, shown in FIG. 7, by virtue of the heat shrinking operation tends to cause the excess length of the film of the open end to shrink and form a more or less tight ring 66 of heat shrunk film material formed around a contracted opening 67.

From the foregoing, it will be seen that the apparatus of the present invention includes a plurality of stations at which sequential operations are performed on articles being packaged. Each carrier has a retractable detent which when engaged allows movement of the carrier by driving connection with the center shaft. When the detent is disengaged, the arm is free wheeling and can be manually moved independent of the center shaft rotating means and the other stations. This feature permits station product loading in a minimum of time. The variable speeds of the drive means allow varying the time the package remains in the heating tunnel to affect a good shrink.

Various types of products can be packaged through the use of the machine of the present invention and the products may assume a variety of types, sizes and configurations. Paper or plastic bags can be compressed and wrapped in shrink film to produce a very tightly compressed bundle which allows for stable palletizing, less warehouse space requirement, and savings in shipping costs. A piece of corrugated board the size of the package can be used at the bottom and top of the package and with the shrink film holding the product secure, it results in a very attractive package through which the product is visible on four sides as well as being well protected. The cost of the normally used corrugated containers is thereby eliminated, along with printing, inventory handling and storage.

It should be evident that various modifications can be made to the described embodiments without departing from the scope of the present invention.

I claim as my invention:

1. The method of packaging articles in a heat shrinkable film which comprises stacking a plurality of such articles on the base of an inside out heat shrinkable bag, compressing the stack a predetermined amount, raising the sides of the bag over the compressed stack along the sides of said bag and overlapping a portion of the top of said stack, holding the overlapped portion against the top of said stack, and heat shrinking said bag about said stack while said contents are so compressed.

2. A method according to claim 1 which includes the step of force cooling the bag after the heat shrinking step.

3. An apparatus for packaging articles in a heat shrinkable film which comprises a drive means, a drive disk driven by said drive means, a plurality of carrier means, said disk having a plurality of locking means spaced along its periphery for selective engagement and disengagement with one of said carrier means, pressure means carried by said carrier means for applying a controlled pressure on said articles while said articles are in a heat shrinkable enclosure, heat shrinking means positioned along the disk periphery for shrinking said enclosure about said articles as the articles pass therethrough on one of said carrier means, and cooling means beyond said heat shrinking means for cooling the articles in their heat shrunk enclosure.

4. An apparatus according to claim 3 in which said carrier means includes a lower pressure platen sufficient in size to accommodate the bottom of said enclosure, and an upper pressure platen having an area less than the area of said enclosure to permit said upper pressure platen to be received within said enclosure, said upper pressure platen having pressure applying surfaces thereon beyond the perimeter of said upper pressure platen to engage an edge portion of said enclosure against the articles after said articles have been compressed.

5. A packaging assembly comprising a rotary drive means, a plurality of radial arms engagable with said drive means, a discharge station, means for disengaging one of said arms from said drive means at said discharge station to permit moving the same to a loading station, said arm carrying a lower platen and an upper platen for supporting a heat shrinkable bag and its contents therebetween, means on said arm for applying a controllable compacting pressure and vertical repeatable height dimension to the contents of the bag at said loading station, a heating tunnel, means for engaging said arm with said drive means beyond said loading station to propel said arm through said heating tunnel and into the aforesaid discharge station, and means for discharging the bag and its contents at said discharge station.

6. The packaging assembly of claim 5 which includes a cooling means arranged to cool the bag in moving from said heating tunnel to said discharge station.

7. An apparatus for packaging articles in a heat shrinkable film which comprises a rotary drive means, a plurality of arms extending radially outwardly from said drive means, means releasably connecting said arms to said drive means, a bag supporting platen positioned on each of said arms, a pressure platen on each of said arms positioned to apply a controlled pressure and positive repeatable height dimension to the contents of a bag when positioned on a bag supporting platen, a heating tunnel in the path of movement of said arms to shrink said bag about its contents while under pressure from said pressure platen, and cooling means following said heating tunnel.

* * * * *